US005165528A

United States Patent [19]

Kozlowski et al.

[11] Patent Number: 5,165,528

[45] Date of Patent: Nov. 24, 1992

[54] CIRCUIT BREAKER LOCKOUT DEVICE

[75] Inventors: Lawrence J. Kozlowski, New Kensington; Lawrence A. Shirey, North Huntingdon, both of Pa.

[73] Assignee: The United States of America as represented by the United States Department of Energy, Washington, D.C.

[21] Appl. No.: 761,525

[22] Filed: Sep. 18, 1991

[51] Int. Cl.[5] ..... H01H 9/28

[52] U.S. Cl. ..... 200/43.15; 200/43.14; 200/43.11

[58] Field of Search ..... 200/43.01, 43.11, 43.14, 200/43.15, 43.19, 43.21; 70/DIG. 30, 209; 700/50 C

[56] References Cited

U.S. PATENT DOCUMENTS

| | | | |
|---|---|---|---|
| 2,937,248 | 5/1960 | Michetti | 200/43.21 |
| 3,109,899 | 11/1963 | Pastene | 200/43.19 |
| 3,170,050 | 2/1965 | Buturuga | 200/43.19 |
| 3,197,581 | 7/1965 | Clifford | 200/43.21 |
| 3,229,056 | 1/1966 | Turnbull | 200/50 A |
| 3,629,529 | 12/1971 | Dietz | 200/45.19 |
| 3,632,917 | 1/1972 | Norden | 200/43.14 |
| 4,158,116 | 6/1979 | Krueger | 200/43.19 |
| 4,467,152 | 8/1984 | Gordy | 200/43.21 |
| 4,882,456 | 11/1989 | Hovanic et al. | 200/43.15 |
| 4,897,515 | 1/1990 | Zubar et al. | 200/43.14 |

*Primary Examiner*—Henry J. Recla
*Assistant Examiner*—Daivd J. Walczak
*Attorney, Agent, or Firm*—William R. Moser; Judson R. Hightower; Richard E. Constant

[57] ABSTRACT

An improved lockout assembly for locking a circuit breaker in a selected off or on position is provided. The lockout assembly includes a lock block and a lock pin. The lock block has a hollow interior which fits over the free end of a switch handle of the circuit breaker. The lock block includes at least one hole that is placed in registration with a hole in the free end of the switch handle. A lock tab on the lock block serves to align and register the respective holes on the lock block and switch handle. A lock pin is inserted through the registered holes and serves to connect the lock block to the switch handle. Once the lock block and the switch handle are connected, the position of the switch handle is prevented from being changed by the lock tab bumping up against a stationary housing portion of the circuit breaker. When the lock pin installed, an apertured-end portion of the lock pin is in registration with another hole on the lock block. Then a special scissors conforming to O.S.H.A. regulations can be installed, with one or more padlocks, on the lockout assembly to prevent removal of the lock pin from the lockout assembly, thereby preventing removal of the lockout assembly from the circuit breaker.

11 Claims, 2 Drawing Sheets

CIRCUIT BREAKER LOCKOUT DEVICE

GOVERNMENT CONTRACT RIGHTS

The invention described herein was made or conceived in the course of work under Contract No. DE-AC11-88PN38014 between the Department of Energy and Westinghouse Electric Corporation, according to which the United States Government has rights in this invention and title thereto is in the Department of Energy.

TECHNICAL FIELD OF THE INVENTION

The present invention relates to an apparatus for safely and conveniently locking an individual circuit breaker (e.g. a 120/240 volt AC circuit breaker) in the off (or on) position as desired without interfering with the remaining circuit breakers in the panel.

BACKGROUND OF THE INVENTION

Many types of circuit breaker lockout devices are known in the prior art. Some have a locking mechanism on the door of a distribution panel. Others have a locking device for an individual circuit breaker.

Presently, there are O.S.H.A. regulations (Regulations 1910.145 and 1910 Subpart s) which require the presence of a safety padlock alone or a special scissors with a padlock affixed for locking out individual circuit breakers when one or more repair or maintenance persons work on the circuit being locked out. The number of circuit breaker lockout devices in the prior art that are designed to be locked out with a padlock alone or with the special scissors and a padlock is very limited.

For example, in U.S. Pat. No. 4,467,152, Gordy discloses a circuit breakout lockout assembly which includes a bent pin arrangement (elements 5 and 6 in FIG. 1 of Gordy). The bent pin arrangement must be inserted into element 10 in two pieces during assembly. The two pieces are then welded together, but the weld is a weak spot in the assembly. The scissors (hasp 7) must be perpendicular to the face of the circuit breaker, as shown in FIG. 3. The combined weight of the hasp 7 and padlock 8 (with up to six padlocks) exert a large amount of torque on the elements 5 and 6 and on the handle of the circuit breaker. Furthermore, this arrangement of the hasp 7 and padlock 8 is very bulky and prevents closure of the door of the distribution panel.

In other prior art, in U.S. Pat. No. 4,897,515, Zubar et al disclose the use of a padlock to lock out distribution panel circuit breakers. The Zubar et al device needs to have precision forming to insure that the mating pieces will match, and any deformation of the two mating pieces renders this device useless. The blocking member of the device (element 16 in FIG. 1 of Zubar et al) can easily be bent out of position allowing undesired operation of the circuit breaker. Furthermore, some of the newer circuit breakers have a shallower shoulder than depicted in the Zubar et al patent (element 28 in FIG. 1), and the device may slip over the shoulder allowing unwanted and hazardous operation of the circuit breaker. Also, a screwdriver or other tool is necessary to install the Zubar et al device.

SUMMARY OF THE INVENTION

Accordingly, it is a primary object of the present invention to provide a circuit breaker lockout device that easily permits installation of a padlock alone or a special scissors with a padlock to conform to O.S.H.A. regulations.

Another object of the invention is to provide a circuit breaker lockout device that avoids the creation of large amounts of torque forces on the lockout device when a padlock alone or special scissors with a padlock are installed on the lockout device.

Another object is to provide a circuit breaker lockout device that is not easily defeated once it is installed on the circuit breaker.

Still another object of the invention is to provide a circuit breaker lockout device that permits a door of a distribution panel to be closed once a padlock alone or a special scissors with a padlock are installed on a circuit breaker.

An additional object of the invention is to provide a circuit breaker lockout device that does not require the use of any tool to install the lockout device.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved lockout assembly for locking a circuit breaker in a selected off or on position is provided. The circuit breaker has a switch handle with a free end with a hole therethrough, and the lockout assembly is comprised of a lock block, adapted to connect to the free end of the switch handle; and a lock pin for connecting the lock block to the circuit breaker. As long as the lock pin is in position, the lockout assembly of the invention serves its function of preventing a change in the switching position of the switch handle.

The lock block includes a first end which is proximal to the circuit breaker when the lock block is connected to the switch handle. The lock block also includes a second end which is distal to the circuit breaker when the lock block is connected to the switch handle. The lock block also includes a first hole that is located near the first end of the lock block. The first hole can be placed in registration with the hole in the free end of the switch handle. The lock block further includes a second hole that is located near the second end of the lock block.

The lock block further includes a lock tab extending downward from the proximal end of the lock block.

The lockout assembly of the invention also includes a lock pin that includes a first end (which is a straight end) that is adapted to be installed through the first lock block hole and through the hole in the free end of the switch handle when those holes are in registration, whereby the lock pin serves to connect the lock block to the switch handle. The lock pin also includes a second end that has an aperture that is placed in registration with the second lock block hole when the straight end of the lock pin is installed through the registered first lock block hole and the hole in the circuit breaker switch handle. When the second lock block hole and the apertured end of the lock pin are in registration, they are adapted to receive a shank or jaws of a locking device such as a padlock alone or a padlock combined with a special scissors required by O.S.H.A. regulations. When the shank of the locking device is installed through the registered second lock block hole and apertured end of the lock pin, the lock pin becomes locked into position. As long as the lock pin is locked in position, the lockout assembly of the invention cannot be removed from the circuit breaker. Only when the locking device is removed, and then the lock pin is subsequently removed, can the lockout assembly of the invention be removed from circuit breaker to permit the switch position of the circuit breaker to be changed.

The lock tab is adapted to engage a stationary portion of the circuit breaker when the lock block and the lock pin are installed on the free end of the circuit breaker switch handle, such that a switch-throwing motion of the circuit breaker switch handle is prevented by the lock tab.

Preferably, the lock block includes a hollow portion adapted to fit over the free end of the circuit breaker switch handle. This hollow portion fits over the free end of the switch handle like a cap. Preferably, the lock block is fabricated from a single piece of or plastic any standard metal stock material. Preferably, the lock pin is fabricated from a single piece of stiff metal wire material having an outer diameter smaller than the respective diameters of the holes through which the lock pin is inserted. The strength and rigidity of the single-piece lock block and single-piece lock pin make the lockout assembly of the invention difficult to defeat.

Preferably, the lock tab has a triangular cross-sectional shape and fits into a space between a base of the switch handle and a stationary portion of a circuit breaker housing adjacent to the switch handle.

In addition, the lock tab can serve as a registration tab for aligning the first hole of the lock block with the hole in the free end of the switch handle. More specifically, preferably, the lock block, holes therein, and lock tab are dimensioned to fit on a particular model of a circuit breaker having its own particular dimensions, such that when the lock tab is placed into the space between the base of the switch handle and the stationary portion of the circuit breaker housing adjacent to the switch handle, the lock tab also serves as a registration tab to align the first hole of the lock block with the hole in the free end of the switch handle. For different models of circuit breakers, the dimensions of the lock block and the location of its holes would be dimensioned accordingly so that the lock tab also serves as a registration tab.

Preferably, the lock block includes a third hole that is located opposite the first hole in the lock block and is placed in registration with the first hole and the hole in the free end of the circuit breaker switch handle when the lock block is installed on the circuit breaker. In this respect, the straight end of the lock pin is adapted to be installed through the first lock block hole, through the hole in the free end of the circuit breaker switch handle, and through the third lock block hole when the holes are in registration.

Preferably, the first hole of the lock block and the second hole of the lock block are located in planes that are at right angles to one another.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION

Figure 1:
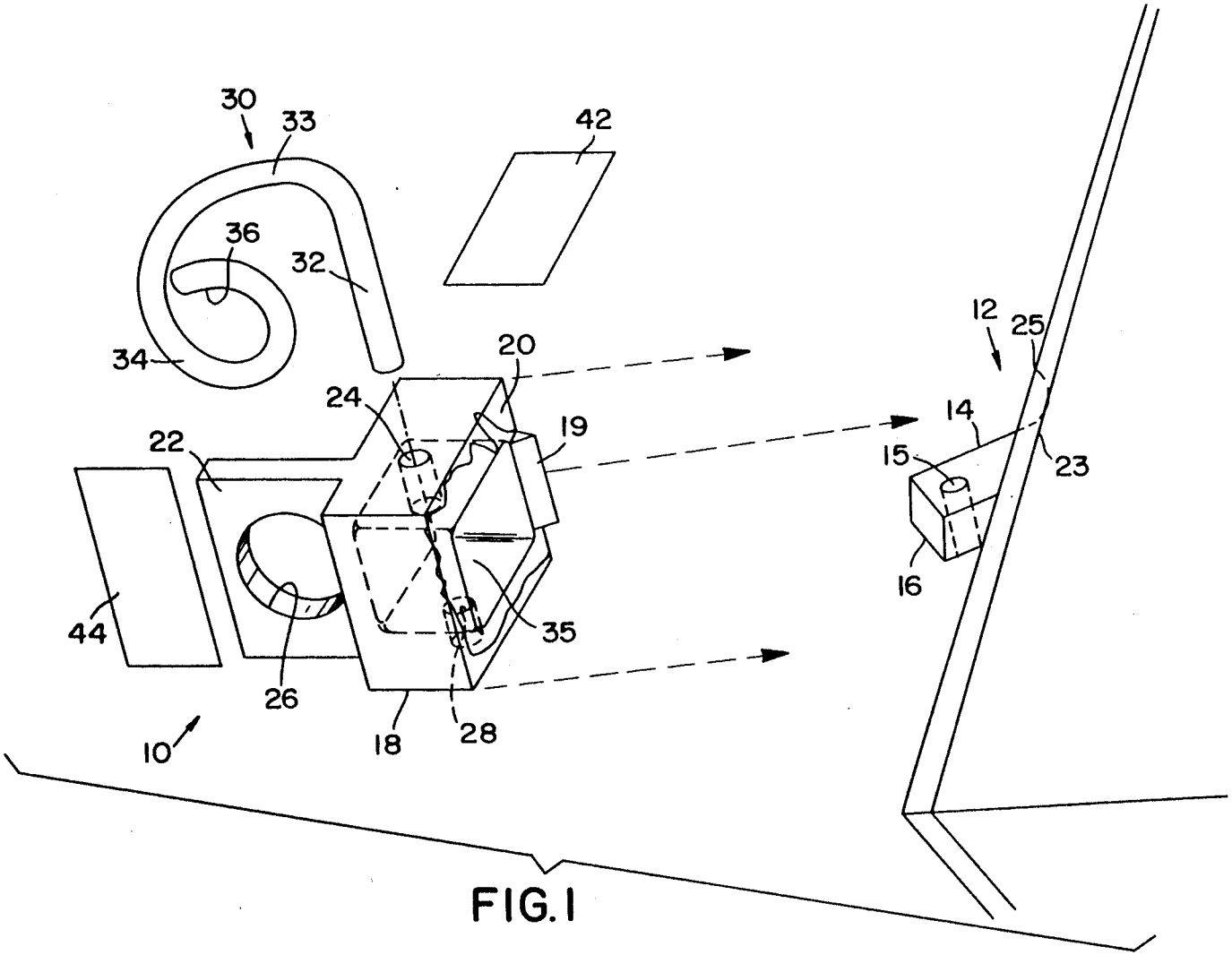
FIG. 1 is an exploded perspective view of a lockout assembly of the invention removed from a switch handle of a circuit breaker to a position normal to the circuit breaker.

With reference to the drawings, and more particularly to FIG. 1, there is disclosed a preferred embodiment of the lockout assembly 10 of the present invention which serves to lock a circuit breaker 12 in a selected off or on position. In FIG. 1, the circuit breaker 12 is in the off position. The circuit breaker 12 has a switch handle 14 with a free end 16 having a hole 15 therethrough, and the lockout assembly 10 includes a lock block 18 adapted to connect to the free end 16 of the switch handle 14.

Figure 2:
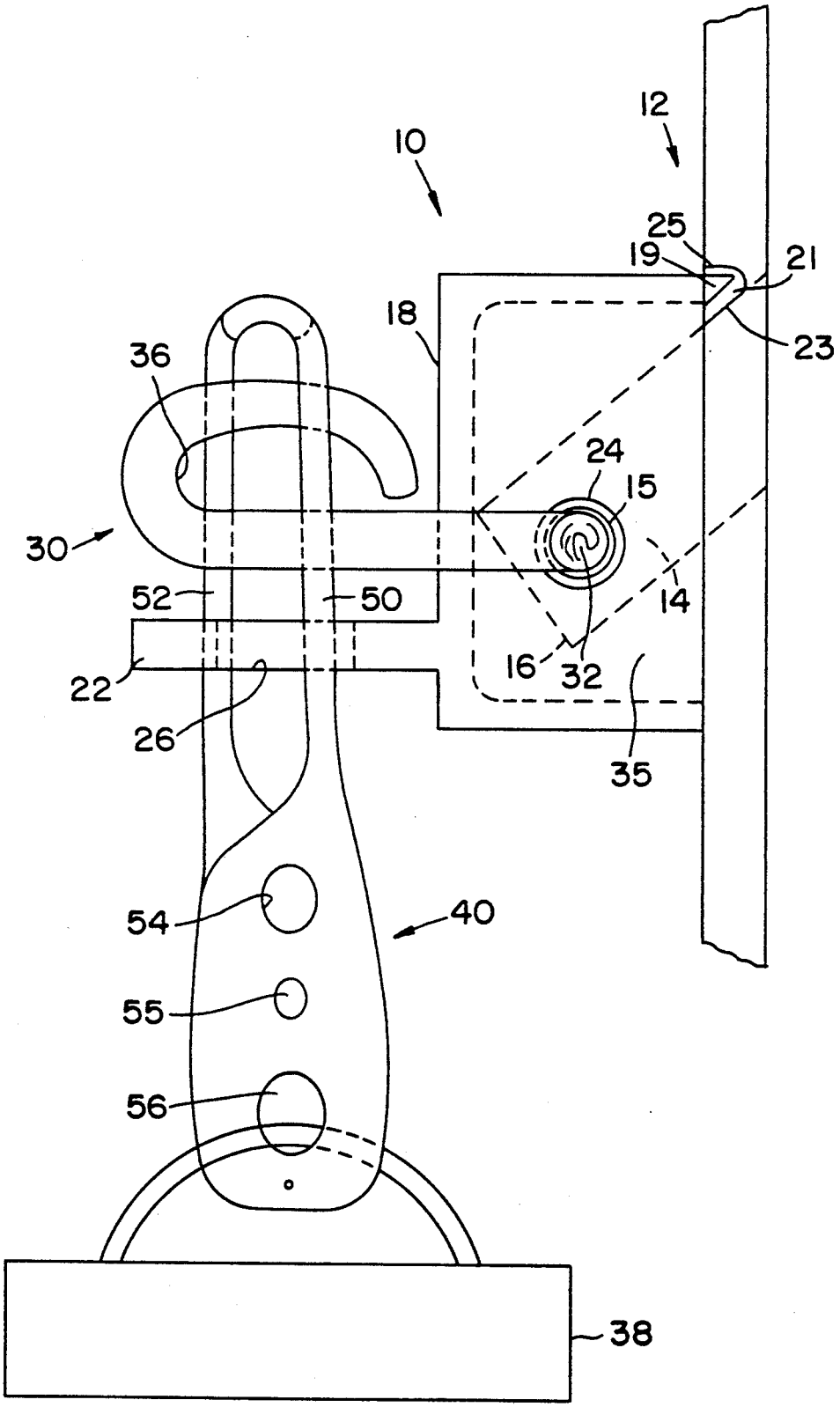
FIG. 2 is schematic, side view of a lockout assembly of the invention, installed on a circuit breaker and including a special scissors and padlock as required by O.S.H.A. regulations.

The lock block 18 includes a first end 20 which is proximal to the circuit breaker 12 when the lock block 18 is connected to the switch handle 14. A second end 22 of the lock block 18 is distal to the circuit breaker 12 when the lock block 18 is connected to the switch handle 14. A first hole 24 is located near the first end 20 of the lock block 18. The first hole 24 is placed in registration with the hole 15 in the free end 16 of the switch handle 14 as shown in FIG. 2. A second hole 26 is located near the second end 22 of the lock block 18. A lock tab 19 extends downward from the proximal end of the lock block 18.

The lockout assembly 10 of the invention also includes a lock pin 30 that includes a first end 32 (which is a straight end 32) that is adapted to be installed through the first lock block hole 24 and through the hole 15 in the free end 16 of the switch handle 14 when those holes are in registration as shown in FIG. 2, whereby the lock pin 30 serves to connect the lock block 18 to the switch handle 14. The lock pin 30 also includes a second end 34 that has an aperture 36 that is placed in registration with the second lock block hole 26 when the straight end 32 of the lock pin 30 is installed through the first lock block hole 24 and the hole 15 in the circuit breaker 12 switch handle 14 which are in registration, as shown in FIG. 2. When the second lock block hole 26 and the aperture 36 of the apertured end 34 of the lock pin 30 are in registration as shown in FIG. 2, they are adapted to receive a shank 50 or jaws of a locking device such as a padlock alone or a padlock 38 (see FIG. 2) combined with a special scissors 40 (see FIG. 2) required by O.S.H.A. regulations.

When the shank 50 of the special scissors 40 is installed through the respectively registered second lock block hole 26 and aperture 36 of the lock pin 30, the lock pin 30 becomes locked into position in the lockout assembly 10. As long as the lock pin 30 is locked in position, the lockout assembly 10 of the invention cannot be removed from the circuit breaker 12. Only when the special scissors 40 is removed, and then the lock pin 30 is subsequently removed, can the lockout assembly 10 of the invention be removed from circuit breaker 12 to permit the switch handle 14 position of the circuit breaker 12 to be changed.

The lock pin 30 also includes a bridging portion 33 that extends from the straight end 32 to the apertured end 34.

The lock tab 19 is adapted to engage a stationary housing portion 25 of the circuit breaker 12 when the lock block 18 and the lock pin 30 are installed on the free end 16 of the circuit breaker 12 switch handle 14, such that a switch-throwing motion of the circuit breaker 12 switch handle 14 is prevented by the lock tab 19.

The lock block 18 includes a hollow portion 35 adapted to fit over the free end 16 of the circuit breaker 12 switch handle 14. The size of the hollow portion 35 may be changed to fit different breakers. This hollow portion 35 fits over the free end 16 of the switch handle 14 like a cap. The lock block 18 is fabricated from a single piece of standard metal stock material. The lock pin 30 is fabricated from a single piece of steel wire material having an outer diameter smaller than the respective diameters of the respective holes through which the lock pin 30 in inserted.

The lock tab 19 has a triangular cross-sectional shape and fits into a space 21 between a base 23 of the switch handle 14 and the stationary portion 25 of a circuit breaker 12 housing adjacent to the switch handle 14. In addition, lock block 18 is dimensioned such that the lock tab 19 serves as a registration tab for aligning the first hole 24 of the lock block 18 with the hole 15 in the free end 16 of the switch handle 14, whereby the holes are placed in registration as shown in FIG. 2. A circuit breaker 12 for which a lockout assembly 10 of the invention has been made and properly dimensioned is a 120/240 Volt AC, Westinghouse Type BA circuit breaker.

The lock block 18 includes a third hole 28 that is located opposite the first hole 24 in the lock block 18 and is placed in registration with the first hole 24 and the hole 15 in the free end 16 of the circuit breaker 12 switch handle 14 when the lock block 18 is installed on the circuit breaker 12. In this respect, the straight end of the lock pin 30 is adapted to be installed through the first lock block hole 24, through the hole 15 in the free end 16 of the circuit breaker 12 switch handle 14, and through the third lock block hole 28 when the holes are in registration.

The first hole 24 of the lock block 18 and the second hole 26 of the lock block 18 ar located in planes that are at right angles to one another. More specifically, the first hole 24 of the lock block 18 is located in plane 42, and the second hole 26 of the lock block 18 is located in plane 44. This right angular planar arrangement facilitates the hanging of the special scissors 40 and padlock 38, as shown in FIG. 2, so that large torque forces are not exerted by the special scissors 40 and padlock 38 on the lockout assembly 10 of the invention.

Referring to FIG. 2, the lockout assembly 10 of the invention is installed on the free end 16 of the circuit breaker 12 in a selected off position. Although all holes in registration are not visible in FIG. 2, the holes that are in registration, so that the straight end 32 of the lock pin 30 passes through them to connect the lockout assembly 10 to the switch handle 14, are: the first hole 24 of the lock block 18; the hole 15 in the free end 16 of the circuit breaker 12; and the third hole 28 of the lock block 18.

Also in FIG. 2, the second hole 26 of the lock block 18 is in registration with the aperture 36 of the lock pin 30 so that a shank 50 of the special scissors 40 required by O.S.H.A. regulations passes through the registered aperture 36 and second hole 26. The other shank 52 of the special scissors 40 passes behind the lock pin 30 and behind the distal end 22 of the lock block 18.

The special scissors 40 has a plurality of holes 54, 55, 56 to accommodate different padlocks, perhaps having shanks of various outer diameters. Different padlocks are used by different repair or maintenance personnel. Thus, when the special scissors 40 required by O.S.H.A. regulations has provision for a plurality of padlocks, a plurality of repair or maintenance personnel can work on the sam circuit protected by the circuit breaker simultaneously. Padlock 38 is installed in hole 56. It is noted that the special scissors 40 and the padlock 38 are hanging vertically and are substantially adjacent to the top stationary housing portion 58 of the circuit breaker 12. In this way, a door for a circuit breaker distribution panel (not shown) would be permitted to close even with lockout assembly 10 of the invention, the special scissors 40, and padlock 38 installed on the circuit breaker 12.

In FIG. 2, it is also noted that the lock tab 19 is located in the space 21 between the base 23 of the switch handle 14 and the portion 25 of a circuit breaker 12 housing adjacent to the switch handle 14. As stated above, because the lock block 18 and the location of its holes 24 and 28 are dimensioned for use with the particular circuit breaker shown in FIG. 2 the lock tab 19 serves as a registration tab for aligning the first hole 24 of the lock block 18 with the hole 15 in the free end 16 of the switch handle 14, whereby the holes are placed in registration so that the straight end 32 of lock pin 30 can be inserted therethrough.

The lock tab 19 in FIG. 2 prevents a switch-throwing motion of the circuit breaker 12 switch handle 14. More specifically, if someone attempted to move the switch handle 14, which is in the down position, the lock tab 19, after, moving through a very short upward movement, would be pushed up against the stationary housing portion 25 of a circuit breaker 12 housing adjacent to the switch handle 14. Once the lock tab 19 rest against the housing portion 25, after only a very short upward motion of the switch handle 14, the switch handle 14 is prevented from further switch-changing motion, whereby the lockout assembly 10 of the invention successfully locks the switch handle 14 in the predetermined locked position. The terms "up" and "down" are to be construed as "right" and "left" or vice versa, for horizontally mounted breakers.

As mentioned above, the lockout assembly 10 of the invention can be used to either lock a circuit breaker in the off position, or it can be used to lock the circuit breaker in the on position. To reverse the function of the lockout assembly of the invention, one would simply remove the lockout assembly from the switch handle, throw the switch in the opposite direction, reverse the orientation of the lock block, and reinstall the lockout assembly of the invention on the switch handle.

Numerous benefits result from employing the principles of the invention. With the invention, a circuit breaker lockout device is provided that easily permits installation of a padlock alone or a special scissors with a padlock to conform to O.S.H.A. regulations. By employing the invention, a circuit breaker lockout device is provided that avoids the creation of large amounts of torque forces on the lockout device when a padlock alone or special scissors with a padlock are installed on the lockout device.

Also, with the invention, a circuit breaker lockout device is provided that is not easily defeated once it is installed on the circuit breaker. By employing the invention, a circuit breaker lockout device is provided that permits a door of a distribution panel to be closed once a padlock alone or a special scissors with a padlock are installed on a circuit breaker. Still further, with the invention, a circuit breaker lockout device is provided that does not require the use of any tool to install the lockout device.

The foregoing description of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A lockout assembly for locking a circuit breaker in a selected off or on position, the circuit breaker having a stationary portion defining a recess and a switch handle with a free end with a hole therethrough, said lockout assembly comprising:

a lock block adapted to connect to the free end of the switch handle, said lock block including a first end which is proximal to the circuit breaker when said lock block is connected to the switch handle, said lock block including a second end which is distal to the circuit breaker when said lock block is connected to the switch handle, said lock block including a first hole that is located near said first end of said lock block and that can be placed in registration with the hole in the free end of the switch handle, said lock block including a second hole that is located near said second end of said lock block, said lock block including a lock tab extending from the first end in a direction toward the circuit breaker from said proximal end of said lock block, and a lock pin that includes a first end that is a straight end and that is adapted to be installed through said first lock block hole and through the hole in the free end of the switch handle when said first lock block hole and the switch handle hole are in registration, whereby said lock pin serves to connect said lock block to the switch handle, said lock pin including a second end that has an aperture that is placed in registration with said second lock block hole when said straight end of said lock pin is installed through said first lock block hole and the hole in the circuit breaker switch handle, wherein said second lock block hole and said apertured end of said lock pin being in registration are adapted to receive a shank or jaws of a locking device, wherein said lock tab engages said recess on said stationary portion of the circuit breaker when said lock block and said lock pin are installed on the free end of the switch handle of the circuit breaker such that a switch-throwing motion of the circuit breaker switch handle is prevented.

2. The lockout assembly described in claim 1 wherein said lock block includes a hollow portion adapted to fit over the free end of the circuit breaker switch handle.

3. The lockout assembly described in claim 1 wherein said lock block is fabricated from a single piece of plastic material.

4. The lockout assembly described in claim 1 wherein said lock block is fabricated from a single piece of metal material.

5. The lockout assembly described in claim 1 wherein said lock pin is fabricated from a single piece of material.

6. The lockout assembly described in claim 1 wherein said lock pin is fabricated from a single piece of metal wire material.

7. The lockout assembly described in claim 1 wherein said lock tab has a triangular cross-sectional shape for fitting into a space between a base of the switch handle and a stationary portion of the circuit breaker housing.

8. The lockout assembly described in claim 1 wherein said lock tab is adapted to fit into a space between a base of the switch handle and a stationary portion of a circuit breaker housing, and wherein said lock block, said holes therein, and said lock tab are dimensioned such that said lock tab also serves as a registration tab for aligning said first hole of said lock block with the hole in the free end of the switch handle, whereby said holes are placed in registration.

9. The lockout assembly described in claim 1 wherein:

said lock block includes a third hole that is located opposite said first hole in said lock block and is placed in registration with said first hole and the hole in the free end of the circuit breaker switch handle when said lock block is installed on the circuit breaker, and said straight end of said lock pin is adapted to be installed through said first lock block hole, through the hole in the free end of the circuit breaker switch handle, and through said third lock block hole when said holes are in registration.

10. The lockout assembly described in claim 1 wherein said first hole of said lock block and said second hole of said lock block are located in planes that are at right angles to one another.

11. A lockout assembly for locking a circuit breaker in a selected off or on position, the circuit breaker having a switch handle with a free end with a hole therethrough, said lockout assembly comprising:

a single-piece lock block including a hollow portion adapted to fit over the free end of the switch handle, said lock block including a first end which is proximal to the circuit breaker when said lock block is fit over the free end of the switch handle, said lock block including a second end which is distal to the circuit breaker when said lock block is fit over the free end of the switch handle, said lock block including a first hole that is located near said first end of said lock block and that can be placed in registration with the hole in the free end of the switch handle, said lock block including a second hole that is located near said second end of said lock block, said lock block including a third hole that is located opposite said first hole in said lock block and is placed in registration with said first hole and the hole in the free end of the circuit breaker switch handle when said lock block is installed on the circuit breaker, wherein said first hole of said lock block and said second hole of said lock block are located in planes that are at right angles to one another, said lock block including a lock tab extending from the first end in a direction toward the circuit breaker from said proximal end of said lock block, and a single-piece lock pin that includes a first end that is a straight end and that is adapted to be installed through said first lock block hole through the hole in the free end of the switch handle when said first lock block hole and the switch handle hole are in registration, whereby said lock pin serves to connect said lock block to the switch handle, said lock pin including a second end that has an aperture that is placed in registration with said second lock block hole when said straight end of said lock pin is installed through said first lock block hole, through the hole in the circuit breaker switch handle, and through said third lock block hole when said holes are in registration, wherein said second lock block hole and said apertured end of said lock pin being in registration are adapted to receive a shank or jaws of a locking device, said lock tab being adapted to fit into a space between a base of the switch handle and a stationary portion of a circuit breaker housing, such that said lock tab also serves as a registration tab for aligning said first hole of said lock block with the hole in the free end of the switch handle, whereby said holes are placed in registration, wherein said lock tab engages the stationary portion of the circuit breaker housing when said lock block and said lock pin are installed on the free end of the switch handle of the circuit breaker, such that a switch-throwing motion of the circuit breaker switch handle is prevented.

* * * * *